US007958999B2

(12) United States Patent
Noda et al.

(10) Patent No.: US 7,958,999 B2
(45) Date of Patent: Jun. 14, 2011

(54) PALLET FOR PACKING GLASS PLATE AND GLASS PLATE PACKING UNIT

(75) Inventors: Takayuki Noda, Otsu (JP); Michiharu Eta, Otsu (JP); Takashi Fujino, Otsu (JP); Kenji Kamee, Otsu (JP)

(73) Assignee: Nippon Electric Glass Co., Ltd., Shiga (JP)

( * ) Notice: Subject to any disclaimer, the term of this patent is extended or adjusted under 35 U.S.C. 154(b) by 139 days.

(21) Appl. No.: 12/311,739

(22) PCT Filed: Nov. 7, 2007

(86) PCT No.: PCT/JP2007/071652

§ 371 (c)(1),
(2), (4) Date: Apr. 10, 2009

(87) PCT Pub. No.: WO2008/068995

PCT Pub. Date: Jun. 12, 2008

(65) Prior Publication Data

US 2010/0000894 A1 Jan. 7, 2010

(30) Foreign Application Priority Data

Dec. 7, 2006 (JP) ..... 2006-331046

(51) Int. Cl.
*B65D 85/48* (2006.01)
*B65D 19/44* (2006.01)

(52) U.S. Cl. ..... 206/454; 206/386; 211/41.14

(58) Field of Classification Search ..... 206/386, 206/599, 449, 454, 451, 593, 448, 600; 211/41.14, 211/41.2, 59.2, 41.1, 41.15, 42; 108/55.1
See application file for complete search history.

(56) References Cited

U.S. PATENT DOCUMENTS 2,839,198 A * 6/1958 Lefevre ..... 211/41.14
3,955,676 A * 5/1976 Hansen et al. ..... 206/451
4,626,017 A * 12/1986 Robertson ..... 296/3

(Continued)

FOREIGN PATENT DOCUMENTS

CN 1621324 6/2005

(Continued)

OTHER PUBLICATIONS

International Preliminary Report on Patentabily and Written Opinion of the International Searching Authority mailed Jun. 18, 2009 for International Application No. PCT/JP2007/071652.

(Continued)

*Primary Examiner* — Steven A. Reynolds
(74) *Attorney, Agent, or Firm* — Wenderoth, Lind & Ponack, L.L.P.

(57) ABSTRACT

A pallet for packing a glass plate include a base part which is disposed at a bottommost portion, for supporting from below a plurality of glass plates piled one upon another in an upright posture, and has a fork insertion portion for insertion of forks of a forklift. The pallet also has a backside part rising from a rear side of the base part, for supporting the glass plates from a rear thereof, and a pedestal part mounted in engagement with at least one of the base part and the backside part so as to receive bottom side portions of the glass plates, in which a lowermost portion of the pedestal part is set lower than a substantial top surface of the base part.

20 Claims, 3 Drawing Sheets

U.S. PATENT DOCUMENTS

| | | | | |
|---|---|---|---|---|
| 5,105,946 | A * | 4/1992 | McDowell | 206/454 |
| 5,676,066 | A * | 10/1997 | Cavalier et al. | 108/55.1 |
| 5,906,282 | A * | 5/1999 | Aldrich et al. | 211/41.14 |
| 6,102,206 | A * | 8/2000 | Pride | 206/454 |
| 6,705,466 | B2 * | 3/2004 | Bartholomew et al. | 206/454 |
| 6,820,752 | B2 * | 11/2004 | Jeskey et al. | 211/41.14 |
| 6,910,591 | B2 * | 6/2005 | Knoll et al. | 211/41.14 |
| 2003/0141213 | A1 * | 7/2003 | Bartholomew et al. | 206/454 |
| 2003/0173314 | A1 * | 9/2003 | Knoll et al. | 211/41.14 |
| 2003/0183590 | A1 * | 10/2003 | Chubb | 211/41.14 |
| 2003/0196971 | A1 * | 10/2003 | Jeskey et al. | 211/41.14 |
| 2004/0168946 | A1 * | 9/2004 | Angeletti et al. | 206/448 |
| 2006/0196838 | A1 * | 9/2006 | Mercure et al. | 211/41.1 |
| 2009/0057182 | A1 * | 3/2009 | Kamitani et al. | 206/451 |

FOREIGN PATENT DOCUMENTS

| | | |
|---|---|---|
| CN | 1863718 | 11/2006 |
| EP | 1 533 250 | 5/2005 |
| JP | 52-128477 | 9/1977 |
| JP | 2005-75366 | 3/2005 |
| JP | 2005-132490 | 5/2005 |
| JP | 2006-315749 | 11/2006 |
| WO | 2005/035394 | 4/2005 |
| WO | 2006/112121 | 10/2006 |

OTHER PUBLICATIONS

International Search Report mailed Jan. 15, 2008 for International Application No. PCT/JP2007/071652.

* cited by examiner

PALLET FOR PACKING GLASS PLATE AND GLASS PLATE PACKING UNIT

TECHNICAL FIELD

The present invention relates to an improvement of a packing technology for packing up a glass plate when the glass plate is transported.

BACKGROUND ART

As well known, in transporting various glass plates including glass substrates for flat-panel displays (hereinafter simply referred to as FPD) such as a liquid crystal display, a plasma display, an electroluminescence display, and a field emission display, a plurality of glass plates are generally packed on a pallet for packing glass plates (hereinafter simply referred to as pallet) in a state of being piled one upon another and interposing protective sheets, such as inserting paper, between the individual glass plates. Various pallets to be used in packing the glass plates of this type have been proposed, and are roughly classified into a pallet in which a plurality of glass plates are piled and packed in a lie-down posture (approximately horizontal posture), and a pallet in which a plurality of glass plates are piled and packed in an upright posture (approximately vertical posture).

As a specific example of the former pallet in which the glass plates are piled and packed in a lie-down posture, for example, Patent Document 1 mentioned below discloses a pallet configured in such a way that glass plates, while being piled in a horizontal posture on a box-shaped pedestal part having an open top, are placed on the top surface of a base part which has an approximately horizontal surface, and that the periphery of the pedestal part is surrounded with an outer wrapping body fixed to the top surface of the base part. As a specific example of the latter pallet in which the glass plates are piled and packed in an upright posture, on the other hand, for example, Patent Document 2 mentioned below discloses a pallet configured in such a way that a pedestal part mounted on the top surface of a base part which has an approximately horizontal surface supports the bottom side portions of glass plates piled in an upright posture, and that a backside part provided upright on the top surface of the base part and a rear of the pedestal part supports the back side of the glass plates piled in an upright posture.

In general, a glass plate package body of this type (hereinafter simply referred to as package body) which is manufactured by having glass plates piled up and packed is stored in a cargo container at the time the package body is transported. Because loading and unloading of the package body into and from the container are carried out with use of a forklift, the base part of any one of the above-mentioned pallets has a fork insertion portion (opening) provided for insertion of the forks of a forklift (refer to the following Patent Documents 1 and 2).

[Patent Document 1] JP 2005-75366 A

[Patent Document 2] JP 2005-132490 A

SUMMARY OF THE INVENTION

Problems to be Solved by the Invention

A general container manufactured based on the international standards is usually used as the above-mentioned container for transportation, and hence its size is restricted. Accordingly, the recent enlargement of various kinds of glass plates (e.g., glass plates with one side having a size of 2400 mm or larger), as represented by a glass substrate for liquid crystal displays, actually brings about a problem on a method of storing the package body in the container. That is, even when a larger one of containers manufactured based on the above-mentioned standards is used, the size of one side of the enlarged glass plates may become larger than the widthwise size of the opening of the container (e.g., the height directional size is 2500 mm and the widthwise size is 2300 mm) in some cases. In this case, the package body having glass plates piled in a horizontal posture and packed in the pallet disclosed in Patent Document 1 cannot substantially be stored in the container because the size of one side of the glass plates becomes larger than the widthwise size of the opening of the container.

In the package body having glass plates piled in an upright posture and packed in the pallet disclosed in Patent Document 2, the pedestal part mounted on the top surface of the base part supports the bottom side portions of the glass substrates. That is, the lowermost portion of the pedestal part is positioned higher than the top surface of the bottom-raised base part. When glass substrates are piled in a vertical posture and packed on this pallet, therefore, the overall height of the package body becomes higher than the height directional size of the opening of the container. Also in this case, it becomes substantially impossible to store the package body in the container. On the other hand, if the glass plates to be piled are piled and packed in a state of being considerably tilted from the vertical posture, it becomes possible to store the package body in the container. However, the number of glass plates loadable in the container is undesirably reduced. This deteriorates the transportation efficiency of glass plates, resulting in an unreasonable increase in the transportation cost.

Though the above-mentioned problem may be solved by separate manufacture of a dedicated container according to the size of glass plates, there occur many unnecessary costs, such as the manufacturing cost for containers and management cost therefor, in this case. That is not a practical measure.

The present invention has been made in view of the above, and a technical object of the present invention is therefore to provide a pallet for packing a glass plate and a glass plate package body which can be stored in a general transport container while maintaining a good load efficiency of large-sized glass plates.

Means for Solving the Problems

In order to solve the above-mentioned problems, a pallet for packing a glass plate according to the present invention includes: a base part which is disposed at a bottommost portion, for supporting from below a plurality of glass plates piled one upon another in an upright posture, and has a fork insertion portion for insertion of forks of a forklift; a backside part rising from a rear side of the base part, for supporting the glass plates from a rear thereof; and a pedestal part mounted in engagement with at least one of the base part and the backside part so as to receive bottom side portions of the glass plates, characterized in that a lowermost portion of the pedestal part is set lower than a substantial top surface of the base part. The substantial top surface of the base part herein means a surface which can contribute to the original function of the base part of supporting glass substrates from below, and does not include partially recessed portion and protruded portion which do not contribute to the function.

According to the configuration as described above, because the lowermost portion of the pedestal part that receives the bottom side portions of glass plates is set lower than the substantial top surface of the base part (hereinafter simply referred to as the top surface of the base part), the overall height of the package body having the glass plates packed can be reduced as compared with the case where glass plates of the same size are supported in the same posture by the pedestal part mounted on the top surface of the base part. Therefore, glass plates can be stored in a general transport container in a state close to a vertical posture without unreasonably tilting the glass plates from the vertical posture, making it possible to maintain a good load efficiency of glass plates in the container.

In this case, it is preferable that the lowermost portion of the pedestal part be positioned below a top surface of the fork insertion portion. It is more preferable that the height directional size from the lowermost portion of the pedestal part to the bottom of the base part be equal to or less than ½ of the height directional size from the top surface of the fork insertion portion to the bottom surface of the base part.

In the above-mentioned configuration, the glass plates may be supported with an upper side thereof being tilted rearward with respect to a lower side thereof.

That is, while, as already stated, the lowermost portion of the pedestal part is set lower than the top surface of the base part so that the overall height of the package body having glass substrates piled on a pallet can be suitably reduced, tilting the glass plates in this way can suitably make the overall height lower.

In this case, it is preferable that the package body should be configured so that the glass plates are tilted within a range of 10 degrees or more and 25 degrees or less with respect to a vertical plane. It is more preferable that the package body should be configured so that the glass plates are tilted within a range of 18 degrees or more and 22 degrees or less.

This makes it possible to optimize the inclination angle of the glass plates to be supported from the dimensional relation with the size of the opening of the container, further improving the load efficiency of glass plates in a container.

The top surface of the pedestal part may be structured to extend along the horizontal surface. This allows the bottom side portions and top side portions of a plurality of piled glass plates, like the top surface of the pedestal part, to extend along the horizontal surface, and hence the overall height of the package body can be kept constant even if the number of glass plates increases. It is therefore possible to load a larger number of glass plates in a container.

With the above-mentioned configuration, it is preferable that the lowermost portion of the pedestal part should be spaced apart upward from a bottom of the base part.

If irregularities are present on the surface of the mount part such as a floor or the like in which a pallet is to be mounted, this can prevent the pedestal part from being deformed by the influence of the irregularities.

With the above-mentioned configuration, the top surface of the fork insertion portion provided at a side of the base part may include an upper part side and a lower part side which has an elevational difference with respect to the upper part side.

This can allow a pallet or a package body to be lifted and moved in a stable posture even in a case where the center of gravity of the pallet is significantly shifted to any one of frontward and rearward with respect to the center position between the two forks of a forklift in the stage where the two forks are inserted in the fork insertion portion provided in a side of the base part of the pallet. Therefore, flexibility of the position at which the fork insertion portion is formed is improved, which is advantageous in designing a pallet. Such an advantage can be enjoyed as follows. First, the two forks of a forklift are inserted in the fork insertion portion so that one fork of the forklift is positioned under the lower part side while the other fork is positioned under the upper part side. If the forks of the forklift are raised in this state, one fork of the forklift contacts the lower part side first, gradually tilting the entire pallet (package body). The center of gravity of the pallet (package body) gradually shifts toward the center position between the two forks of the forklift in accordance with the inclination of the pallet (package body). As the forks of the forklift are raised further, the other fork of the forklift contacts the upper part side, and hence the entire pallet (package body) is supported by the forks of the forklift while being tilted according to the elevational difference between the upper part side and the lower part side. Therefore, the elevational difference between the upper part side and the lower part side at the top surface of the fork insertion portion is set in consideration of the center of gravity of the pallet or the package body, and hence the center of gravity of the pallet can be positioned in approximately the center position between the two forks in the stage where the pallet is lifted by the forks of the forklift.

A glass plate package body according to the present invention, which is created to solve the above-mentioned problems, is characterized in that a plurality of glass plates are piled and packed in an upright posture, while interposing a protective sheet between the individual glass plates, in the pallet for packing a glass plate, which includes the above-mentioned configuration.

Such a configuration can enjoy the same operational effect as that of the pallet for packing a glass plate, which is already described.

With the above-mentioned configuration, it is preferable that the glass plates should have one side with a size equal to or larger than 2400 mm.

In other words, the height of a package body poses a problem in relation to the opening of a container when storing such large-sized glass plates in a container in the state of the package body, and hence the package body according to the present invention which suitably reduces the overall height while maintaining the good load efficiency of glass substrates becomes more useful.

EFFECT OF THE INVENTION

According to the present invention, as apparent from the above, the lowermost portion of the pedestal part which supports the bottom side portions of glass plates is set lower than the upper surface of the base part, and hence the overall height of the package body can be suitably reduced as compared with the case where glass plates of the same size are supported in the same tilted posture by the pedestal part mounted on the top surface of the base part. Therefore, glass plates can be stored in a general transport container in a state close to a vertical posture without unreasonably tilting the glass plates from the vertical posture, making it possible to maintain a good load efficiency of glass plates in the container.

BRIEF DESCRIPTION OF THE DRAWINGS

FIG. 2(*b*) is a diagram schematically illustrating a state where the forks of the forklift are further raised from the state illustrated in FIG. 2(*a*).

DESCRIPTION OF SYMBOLS

Figure 1:
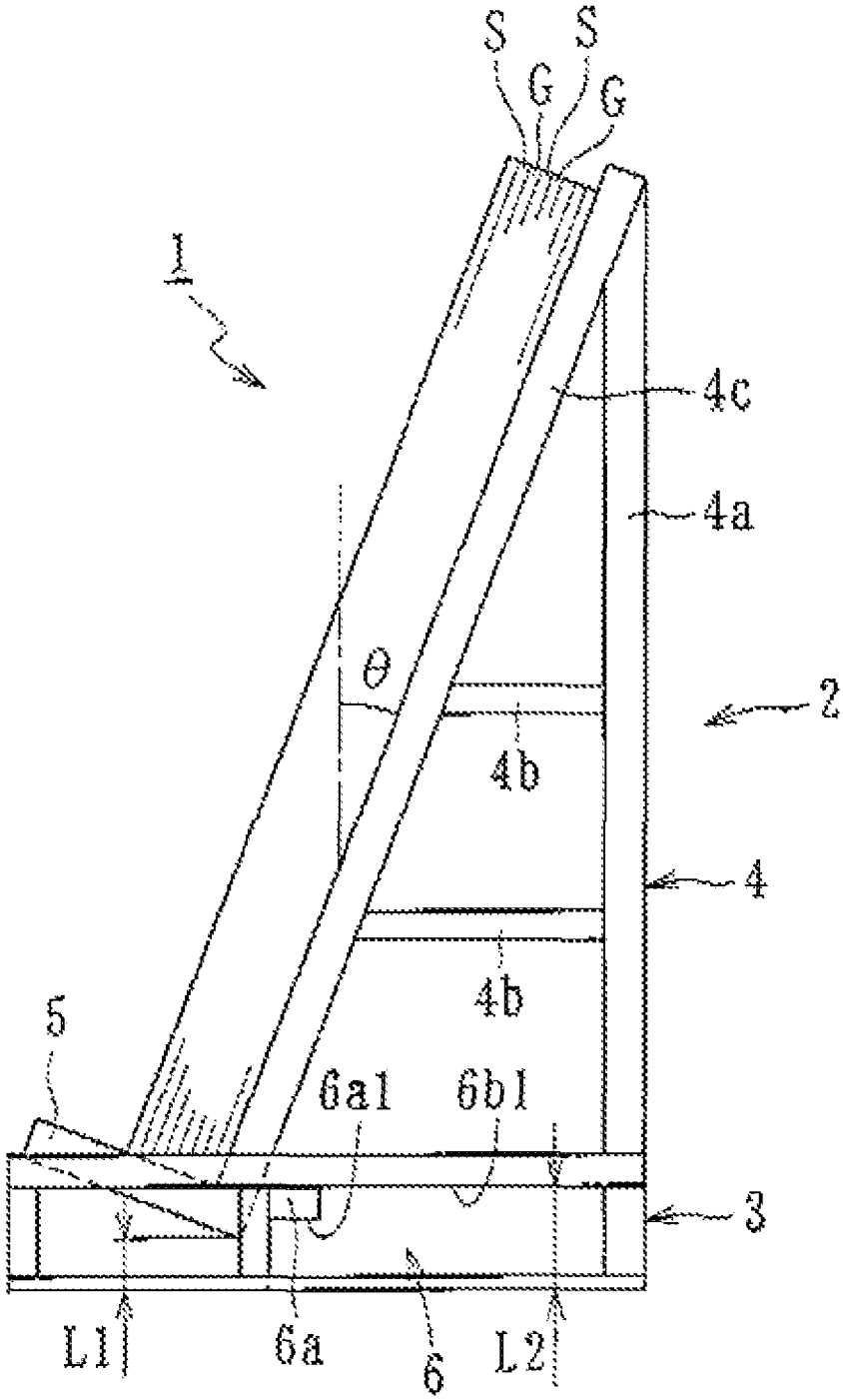
FIG. 1 is a side view schematically illustrating a glass plate package body according to a first embodiment of the present invention.

1, 11 glass plate package body
2, 12 glass plate packing pallet
3 base part
4 backside part
4*a* backrest support
4*b* reinforcing member
4*c* backrest part
5, 15 pedestal part
6 fork insertion portion
6*a* fork support stabilizing member
6*a*1 lower part side
6*b*1 upper part side

DETAILED DESCRIPTION OF THE INVENTION

Hereinafter, embodiments of the present invention are described with reference to the accompanying drawings.

FIG. 1 is a side view exemplarily illustrating a glass plate package body according to a first embodiment of the present invention. As illustrated in the diagram, this glass plate package body 1 is configured by having a plurality of glass plates G piled and packed in an upright posture on a glass plate packing pallet 2 to be described later. The glass plate G is a glass substrate with sides having sizes of 2400 mm or larger for a liquid crystal display. A foam resin sheet serving as a protective sheet S intervenes between a plurality of glass plates G, and the foaming resin sheet has a size larger than the size of the plate surface of the glass plate G.

The pallet 2 includes a base part 3 disposed at a bottommost portion for supporting from below the plurality of glass plates G, which are piled one upon another in an upright posture, a backside part 4 rising from the rear side of the base part 3 for supporting the glass plates G from the rear thereof, and a pedestal part 5 which receives bottom side portions of the glass plates G. According to this embodiment, though the pallet 2 is entirely formed of a metal (preferably stainless steel), the pallet 2 may be partly or entirely formed of a material, such as FRP, if there is no problem on the strength.

The base part 3 has a fork insertion portion 6 at its side, into which the forks of the forklift are to be inserted. Therefore, the top surface of the base part 3 is bottom-raised to form the fork insertion portion 6.

The backside part 4 includes a backrest support 4*a* provided upright at the rear end portion of the top surface of the base part 3, and a backrest part 4*c* fixed ahead of the backrest support 4*a* via reinforcing members 4*b*. One end side of the pedestal part 5 is fixed to the lower end portion of the backrest part 4*c*, with the integration of the backrest parts 4*c* and the pedestal part 5 forming an L-shaped member. In the state of the package body 1, the bottom side portions and the back side of glass plates G which are piled in an upright posture are supported respectively by the top surface of the pedestal part 5 and the front surface of the backrest part 4*c*. A rubber sheet or a foam resin sheet as a cushion member (not shown) is adhered to the top surface of the pedestal part 5 and the front surface of the backrest part 4*c*. The thicknesswise size of the pedestal part 5 is made smaller than the height directional size from the bottom of the base part 3 to the top surface thereof.

The lowermost portion of the pedestal part 5 (intersection of the bottom surface of the pedestal part 5 and the back side of the backrest part 4*c* in the illustrated example) is set lower than the top surface of the fork insertion portion 6 (topmost part when the top surface of the fork insertion portion 6 has an elevational difference). It is preferred that in this state, a height directional size L1 from the lowermost portion of the pedestal part 5 to the bottom of the base part 3 should become equal to or less than ½ (more preferably equal to or less than ⅓) of a height directional size L2 from the top surface of the fork insertion portion 6 to the bottom surface of the base part 3. This can allow the overall height of the package body to be reduced, for example, as compared with the case where glass plates G of the same size are supported in the same posture by the pedestal part mounted on the top surface of the base part. Therefore, glass plates G with sides having a size of approximately 2400 mm can be stored in a general transport container having an opening of a vertical and horizontal size of, for example, 2500 mm×2300 mm in a state close to a vertical posture without unreasonably tilting the glass plates G from the vertical posture. This makes it possible to maintain a good load efficiency of glass plates in the container.

Further, the overall height of the package body 1 becomes smaller as the glass plates G are tilted from the vertical posture, but when the glass plates G are tilted inadequately, the load efficiency of glass plates G in the container gets lower. It is therefore preferable that the front side of the backrest part 4*c*, which determines the inclination angle of the glass plates G, should have an inclination angle θ of 10 degrees or greater and 25 degrees or less with respect to its vertical plane, more preferably 18 degrees or greater and 22 degrees or less. This makes it possible to optimize the inclination angle of the glass plates G to be supported from a viewpoint of the dimensional relation with the size of the opening of the container, thereby further improving the load efficiency of glass plates G in the container. Specifically, for example, two package bodies 1 can be arranged in parallel in a container and stored with their back sides abutting against each other. It is therefore possible to suitably secure the load efficiency of the glass plates G. Though, in the illustrated example, the top surface of the pedestal part 5 has the rear side tilting downward with respect to the horizontal plane compared to the front side with an angle with respect to the front surface of the backrest part 4*c* being kept at approximately 90 degrees, the top surface of the pedestal part 5 may be structured to extend along the horizontal plane. With this configuration, like the top surface of the pedestal part 5, therefore, the bottom side portions and top side portions of a plurality of piled glass plates G extend along the horizontal plane, and hence the overall height of the package body 1 can be kept constant even if the number of the glass plates G increases.

Because the lowermost portion of the pedestal part 5 is set lower than the top surface of the fork insertion portion 6 as described above, the fork insertion portion 6 provided at the side of the base part 3 is provided at a position closer to the rear side of the base part 3 so as not to interfere with the pedestal part 5. On the other hand, the glass plates G are piled on the pallet 2 in the form of the package body 1, and hence the center of gravity shifts forward as compared with the case of the pallet 2 alone. Therefore, it may become difficult to lift the package body 1 in a stable posture with the forklift when moving the package body 1. In this respect, a fork support stabilizing member 6*a*, which projects downward, is fixed to the front side of the top surface of the fork insertion portion 6 to provide an elevational difference at the top surface of the fork insertion portion 6. That is, a portion of the top surface of the fork insertion portion 6, which corresponds to the bottom surface of the fork support stabilizing member 6*a*, serves as a lower part side 6*a*1, and a portion rearward of the lower part side 6*a*1 serves as an upper part side 6*b*1. This makes it possible to lift and move the package body 1 in a stable posture even in a case where the center of gravity of the package body 1 is shifted ahead of the center position of the two forks of the forklift with the two forks being inserted in the fork insertion portion 6.

Figure 2A:
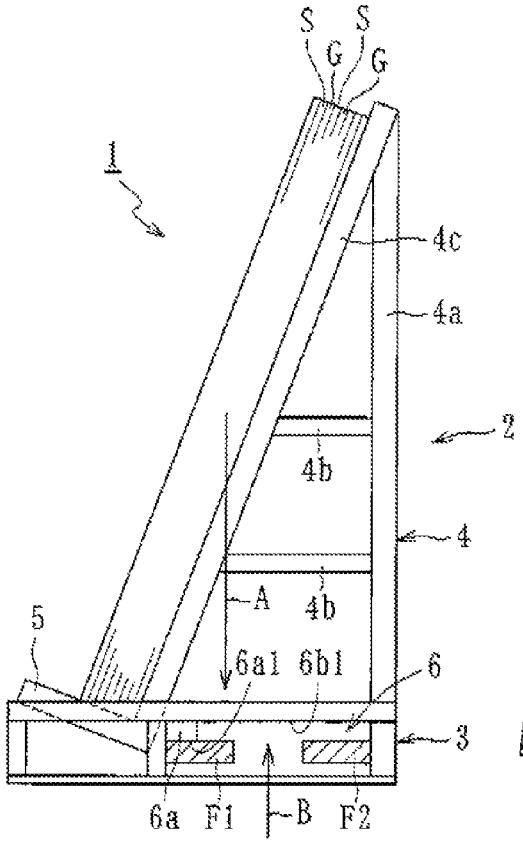
FIG. 2(*a*) is a diagram schematically illustrating a state where forks of a forklift are inserted in a fork insertion portion of the glass plate package body.
Figure 2B:
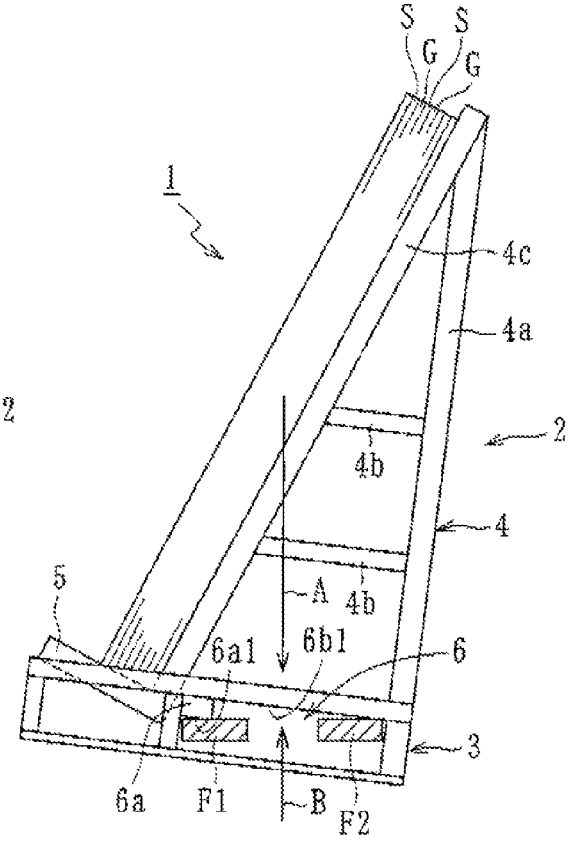

Such an advantage can be enjoyed by carrying out the following procedures. First, as illustrated in FIG. 2(*a*), two forks F1, F2 of the forklift are inserted in the fork insertion portion 6 so that one fork F1 of the forklift is positioned under the lower part side 6*a*1 while another fork F2 is positioned under the upper part side 6*b*1. In this state, the center of gravity of the package body 1 (arrow A in the diagram) is shifted ahead of the center position (arrow B in the diagram) between the two forks F1, F2 of the forklift. Next, when the forks F1, F2 of the forklift are lifted further from the state illustrated in FIG. 2(*a*), the front side of the package body 1 is gradually lifted with only the one fork F1 of the forklift being in contact with the lower part side 6*a*1 first, and hence the center of gravity of the package body 1 (arrow A in the diagram) gradually shifts toward the center position (arrow B in the diagram) between the two forks F1, F2 of the forklift. As the forks F1, F2 of the forklift are lifted further, the another fork F2 of the forklift contacts the upper part side 6*b*1 as illustrated in FIG. 2(*b*), lifting the package body 1 tilted according to the elevational difference between the upper part side 6*b*1 and the lower part side 6*a*1. Therefore, by setting the elevational difference between the upper part side 6*b*1 and the lower part side 6*a*1 at the top surface of the fork insertion portion in consideration of the center of gravity of the package body 1, the center of gravity of the package body 1 (arrow A in the diagram) can be approximately aligned with the center position between the two forks (arrow B in the diagram) when the package body 1 is lifted by the forks of the forklift, whereby the package body 1 can be lifted and moved in the stable posture. In order to smoothly and surely tilt the package body 1, the lengthwise size of the lower part side 6*a*1 is made smaller than the widthwise sizes of the forks F1, F2 of the forklift.

The upper part side 6*b*1 is longer in a lengthwise direction than the lower part side 6*a*1, and hence the two forks of the forklift can be allowed to abut only on the upper part side 6*b*1 to lift the pallet 2 when moving the pallet 2 alone. Therefore, even the pallet 2 alone whose center of gravity is positioned rearward as compared with the package body 1, can be moved using the same fork insertion portion 6. In this case, the pallet 2 is lifted as it is with the posture unchanged and untilted.

According to this embodiment, the lowermost portion of the pedestal part 5 is spaced apart upward from the bottom of the base part 3, and hence the pedestal part 5 is prevented from being deformed even when the surface of a floor or the like where the pallet 2 is to be mounted has irregularity. From a similar point of view, the pedestal part 5 is fixed only to the backrest part 4*c* with a clearance between the pedestal part 5 and the base part 3 maintained. With this configuration, even if the base part 3 is deformed when the surface of the floor or the like has irregularity as described above, or when the forks of the forklift are inserted in the fork insertion portion 6 to lift the pallet 2, the pedestal part 5 is prevented from being deformed with the deformation of the base part 3 as much as possible. Therefore, the supported state of the bottom side portions of glass plates G by the pedestal part 5 is not influenced by the deformation of the base part 3 and is maintained satisfactorily. As a result, undesirable stress is not applied to the bottom side portions of the glass plates G, thus making it possible to suppress, as much as possible, the situation where the glass plates G break. In order to enjoy such an advantage more certainly, it is important that a material for the pedestal part 5, a positional relationship between the pedestal part 5 and the base part 3, rigidity of the pedestal part 5, etc. should be appropriately set in relation to the entire weight of the glass plates G.

Figure 3:
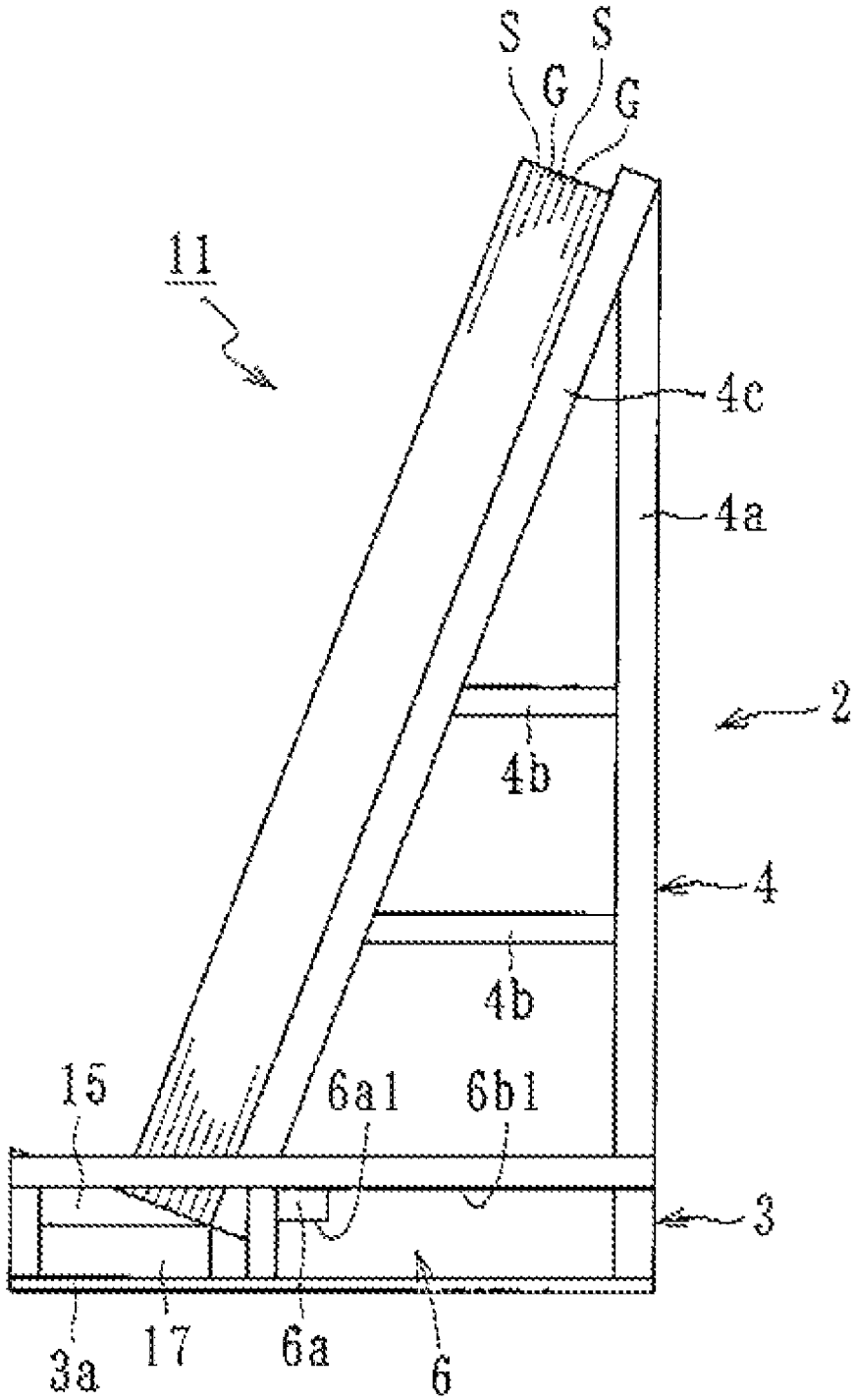
FIG. 3 is a side view schematically illustrating a glass plate package body according to a second embodiment of the present invention.

FIG. 3 is a side view exemplarily illustrating a glass plate package body according to a second embodiment of the present invention. As illustrated in the diagram, a package body 11 according to the second embodiment differs from the package body 1 according to the first embodiment in the structure of a pallet. This difference is described below. Same reference symbols are given to common components in the diagram.

As illustrated in the diagram, in a pallet 12 used for this package body 11, a pedestal part 15 is not fixed to the backrest part 4*c* and is placed in a non-connected state on a bottom member 3*a* of the base part 3 via a cushion member 17. That is, the base part 3, the pedestal part 15, and the cushion member 17 are not fixed to one another, but are merely in physical contact with one another. With the pedestal part 15 being placed on the top surface of the cushion member 17, its rear end side (lowermost portion in the illustrated example) physically contacts the front surface of the backrest part 4*c*. In this state, the lowermost portion of the pedestal part 15 is positioned lower than the top surface of the fork insertion portion 6 of the base part 3. The cushion member 17 is formed by a rubber sheet or a foam resin sheet, and has a thickness set to 10 mm to 50 mm and a size substantially the same as the size of the pedestal part 15. The pedestal part 15 is made by a single integral member, and is formed of a metal (preferably stainless steel) which has such a rigidity as not to follow the deformation of the base part 3 if such deformation occurs.

In the package body 11, the pedestal part 15 is placed on the base part 3 in a non-connected state and is configured so as not to follow the deformation of the base part 3, and hence even if the base part 3 of the pallet 12 is deformed as the forks of a forklift are inserted in the fork insertion portion 6 formed in the base part 3 of the pallet 12 to lift the package body 11, the supported state of the bottom side portions of the glass plates G by the pedestal part 15 is not influenced by the deformation of the base part 3 and is maintained satisfactorily. As a result, undesirable stress is not applied to the bottom side portions of the glass plates G, thus making it possible to suppress, as much as possible, the situation where the glass plates G break. In order to enjoy such an advantage more certainly, it is important that a material for the pedestal part 15, a positional relationship between the pedestal part 15 and the base part 3, rigidity of the pedestal part 15, etc. should be appropriately set in relation to the entire weight of the glass plates G.

Because the overall height of the package body 11 can be made lower adequately as per the package body 1 described in the description of the first embodiment, the package body 11 can be stored in a general transport container while maintaining the load efficiency of glass plates G well. Further, because the lower part side 6*a*1 and the upper part side 6*b*1 are formed on the top surface of the fork insertion portion 6 of the base part 3 by the fork support stabilizing member 6*a*, the package body 11 can be lifted and moved in a stable posture by a forklift.

The present invention is not limited to the above-mentioned embodiments, and can be modified in various forms.

For example, the above-mentioned descriptions of the first and second embodiments are given of the case where the lower part side and upper part side are provided at the top surface of the fork insertion portion of the base part to permit a package body to be lifted and moved in a stable posture when the package body is lifted by a forklift. However, if an increase in the weight of the package body does not pose a problem, a weight may be attached to a pallet to adjust the center of gravity of a package body so that the center of gravity of the package body is shifted to the center position between the two forks of the forklift when the forks of the forklift are inserted in the fork insertion portion. In this case, the weight is preferably detachable from the pallet.

At the time of transportation, after glass plates are piled one upon another in an upright posture on the pallet described above, a belt, a stretch film or the like may be wound around the pallet from the circumference of the glass plate to fix the glass plates to the pallet as needed, thus forming a package body. Further, after the glass plates are piled one upon another in an upright posture, a separate plate member or the like may be provided so as to surround the remaining three side portions excluding the backside part, which supports the back side of the piled glass plates, and a belt, a stretch film or the like may be wound around the separate plate member to be fixed to the pallet.

Though the above-mentioned descriptions of the first and second embodiments are given of a case of packing glass substrates for a liquid crystal display, the pallet and the package body according to the present invention can be suitably used for technologies for packing not only the glass substrates for liquid crystal displays, but also glass substrates for various image display apparatuses, such as a plasma display, an electroluminescence display, and a field emission display, and glass substrates which are used as base members for forming various electronic display-function elements and thin films.

The invention claimed is:

1. A pallet for packing a glass plate, the pallet comprising:

a base part which is disposed at a bottommost portion, for supporting from below a plurality of glass plates piled one upon another in an upright posture, the base part including a fork insertion portion for insertion of forks of a forklift;

a backside part rising from a rear side of the base part, the backside part for supporting the glass plates from a rear thereof; and a pedestal part mounted in engagement with at least one of the base part and the backside part so as to receive bottom side portions of the glass plates, wherein a lowermost portion of the pedestal part is set lower than a substantial top surface of the base part, the fork insertion portion is formed on a side of the base part, and a top surface of the fork insertion portion has a contact portion for the forks of the forklift, the contact portion including a higher part surface and a lower part surface that is located further away from the backside part than the higher part surface and protrudes downward further than the higher part surface, the higher part surface and the lower part surface being positioned to each contact one of the forks of the forklift when the pallet is lifted and supported by the forklift such that the pallet is tilted toward the backside part.

2. A pallet for packing a glass plate according to claim 1, wherein the lowermost portion of the pedestal part is positioned below the top surface of the fork insertion portion.

3. A pallet for packing a glass plate according to claim 1, wherein the pallet supports the glass plates such that an upper side of the glass plates is tilted toward the backside part with respect to a lower side of the glass plates.

4. A pallet for packing a glass plate according to claim 3, wherein the glass plates are tilted within a range of 10 degrees or more and 25 degrees or less with respect to a vertical plane.

5. A pallet for packing a glass plate according to claim 1, wherein the lowermost portion of the pedestal part is spaced apart and upward from a bottom of the base part.

6. A pallet for packing a glass plate according to claim 1, wherein the top surface of the fork insertion portion comprises an upper part side having the higher part surface and a lower part side having the lower part surface.

7. A glass plate package body comprising the pallet according to claim 1 having a plurality of glass plates piled and packed in an upright posture with a protective sheet between adjacent pairs of the glass plates.

8. A glass plate package body according to claim 7, wherein the glass plates have at least one side with a size equal to or larger than 2400 mm.

9. A pallet for packing a glass plate according to claim 2, wherein the pallet supports the glass plates such that an upper side of the glass plates is tilted toward the backside part with respect to a lower side of the glass plates.

10. A pallet for packing a glass plate according to claim 2, wherein the lowermost portion of the pedestal part is spaced apart and upward from a bottom of the base part.

11. A pallet for packing a glass plate according to claim 3, wherein the lowermost portion of the pedestal part is spaced apart and upward from a bottom of the base part.

12. A pallet for packing a glass plate according to claim 4, wherein the lowermost portion of the pedestal part is spaced apart and upward from a bottom of the base part.

13. A pallet for packing a glass plate according to claim 9, wherein the lowermost portion of the pedestal part is spaced apart and upward from a bottom of the base part.

14. A pallet for packing a glass plate according to claim 2, wherein the top surface of the fork insertion portion comprises an upper part side having the higher part surface and a lower part side having the lower part surface.

15. A pallet for packing a glass plate according to claim 3, wherein the top surface of the fork insertion portion comprises an upper part side having the higher part surface and a lower part side having the lower part surface.

16. A pallet for packing a glass plate according to claim 4, wherein the top surface of the fork insertion portion comprises an upper part side having the higher part surface and a lower part side having the lower part surface.

17. A pallet for packing a glass plate according to claim 5, wherein the top surface of the fork insertion portion comprises an upper part side having the higher part surface and a lower part side having the lower part surface.

18. A pallet for packing a glass plate according to claim 10, wherein the top surface of the fork insertion portion comprises an upper part side having the higher part surface and a lower part side having the lower part surface.

19. A pallet for packing a glass plate according to claim 11, wherein the top surface of the fork insertion portion comprises an upper part side having the higher part surface and a lower part side having the lower part surface.

20. A pallet for packing a glass plate according to claim 12, wherein the top surface of the fork insertion portion comprises an upper part side having the higher part surface and a lower part side having the lower part surface.

* * * * *